United States Patent [19]

Ro

[11] Patent Number: 5,039,105

[45] Date of Patent: Aug. 13, 1991

[54] GOLF TRAINING APPARATUS

[76] Inventor: Abraham E. Ro, 45 Deerfield Rd., Whippany, N.J. 07981

[21] Appl. No.: 493,943

[22] Filed: Mar. 15, 1990

[51] Int. Cl.[5] ..... A63B 69/36

[52] U.S. Cl. ..... 273/183 B; 273/188 R; 273/190 R

[58] Field of Search ..... 273/183 B, 188–193

[56] References Cited

U.S. PATENT DOCUMENTS

| | | | |
|---|---|---|---|
| 2,611,610 | 9/1952 | Hara | 273/183 B |
| 3,698,721 | 10/1972 | Stewart | 273/188 R |
| 4,758,000 | 7/1988 | Cox | 273/190 R |

*Primary Examiner*—Theatrice Brown

*Attorney, Agent, or Firm*—Ribis, Graham & Curtin; Richard T. Laughlin

[57] ABSTRACT

A golf training apparatus which is adjustable to suit the height and arm length and body tilt angle and shoulder angle of a specific golfer is provided. The apparatus has a shoulder guide and hand guide unit and a pendulum type visual unit for setting the timing of a golf swing. The shoulder guide and hand guide unit has seven different adjustable subassemblies. The apparatus is adjusted and is set for each different golfer to assure that the golf swing of a sepcific golfer is always repeated in the exact same way. The body tilt angle and swing axis of the golfer is the same at each practice session, when set for the specific golfer.

8 Claims, 6 Drawing Sheets

FIG. 4
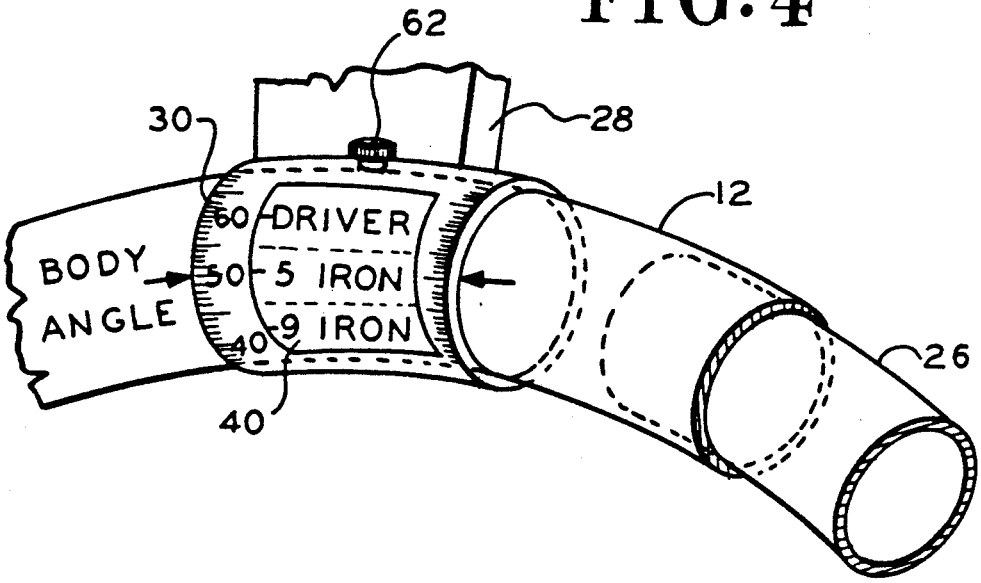
FIG. 5
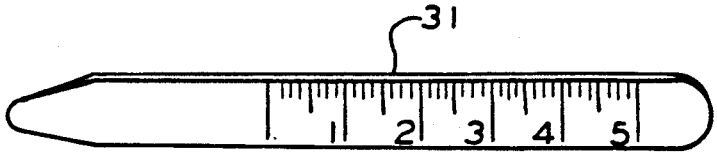
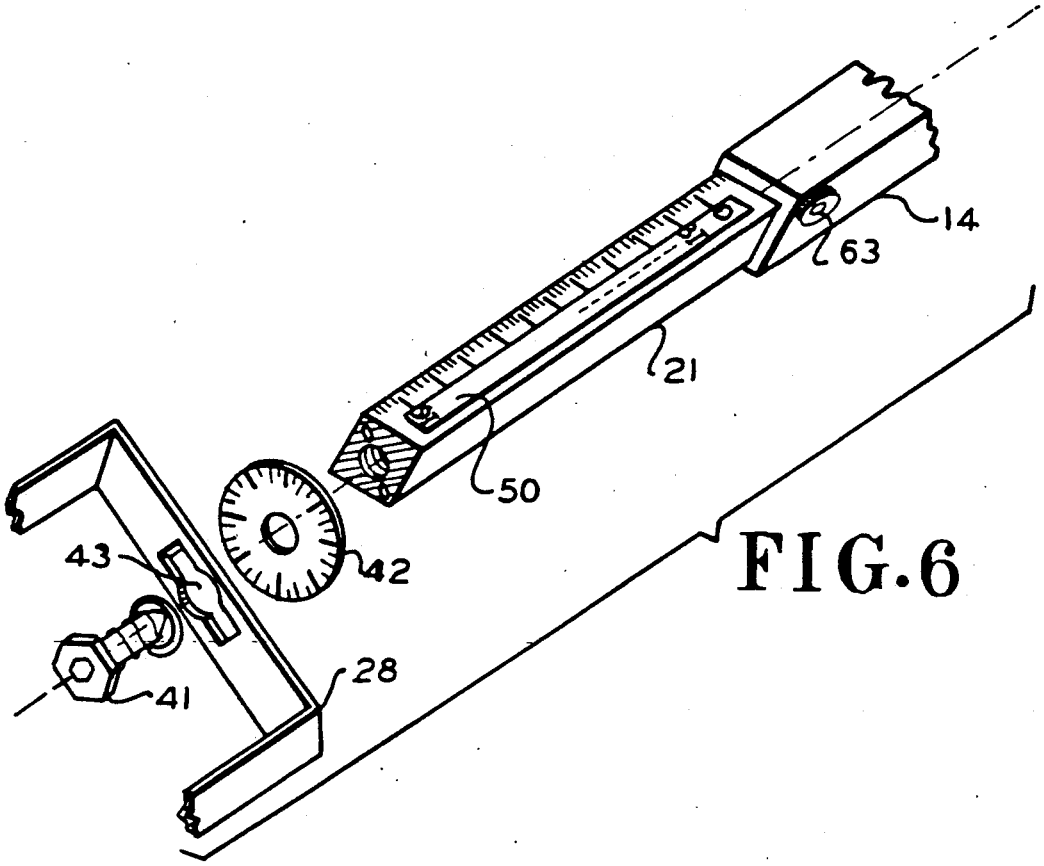
FIG. 6

GOLF TRAINING APPARATUS

The invention generally relates to a golf training apparatus, and in particular, the invention relates to a golfer self-training apparatus having golfer positioning and guiding means.

BACKGROUND OF THE INVENTION

The prior golfer self-training apparatus includes a golfer positioning means. One problem with the prior art golfer self-training apparatus is that the apparatus cannot be adjusted to custom fit the height and arm length and body stance of a specific golfer.

SUMMARY OF THE INVENTION

According to the present invention, a golfer training apparatus is provided for self-training and self-practice by a golfer. This apparatus includes golfer guide means with adjusting means, support means with adjusting means, golfer positioning means with adjusting means, and visual timing means with adjusting means.

By using the plurality of adjusting means, the golfer training apparatus can be custom set and fitted to a golfer, in order to match the height and arm length and body stance of the golfer.

The foregoing and other objects, features and advantages will be apparent from the following description of the preferred embodiment of the invention as illustrated in the accompanying drawings

BRIEF DESCRIPTION OF THE DRAWINGS

FIG. 4 is an enlarged view of a portion of FIG. 2;

FIG. 5 is an enlarged view of a portion of FIG. 2;

FIG. 6 is an enlarged view of a portion of FIG. 1;

DESCRIPTION OF THE PREFERRED EMBODIMENT

Figure 1:
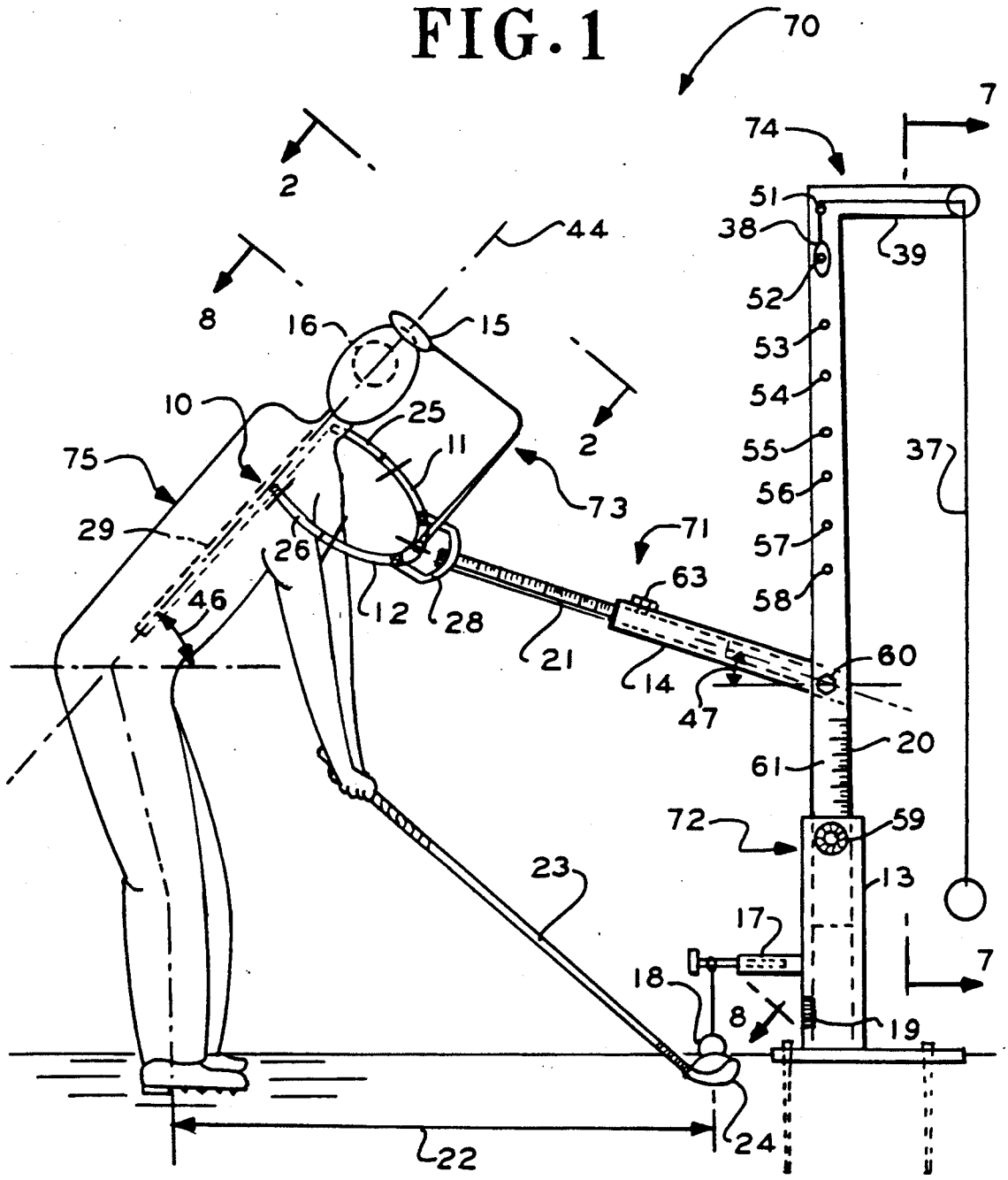
FIG. 1 is an elevation view of a golfer training apparatus according to the invention.
Figure 2:
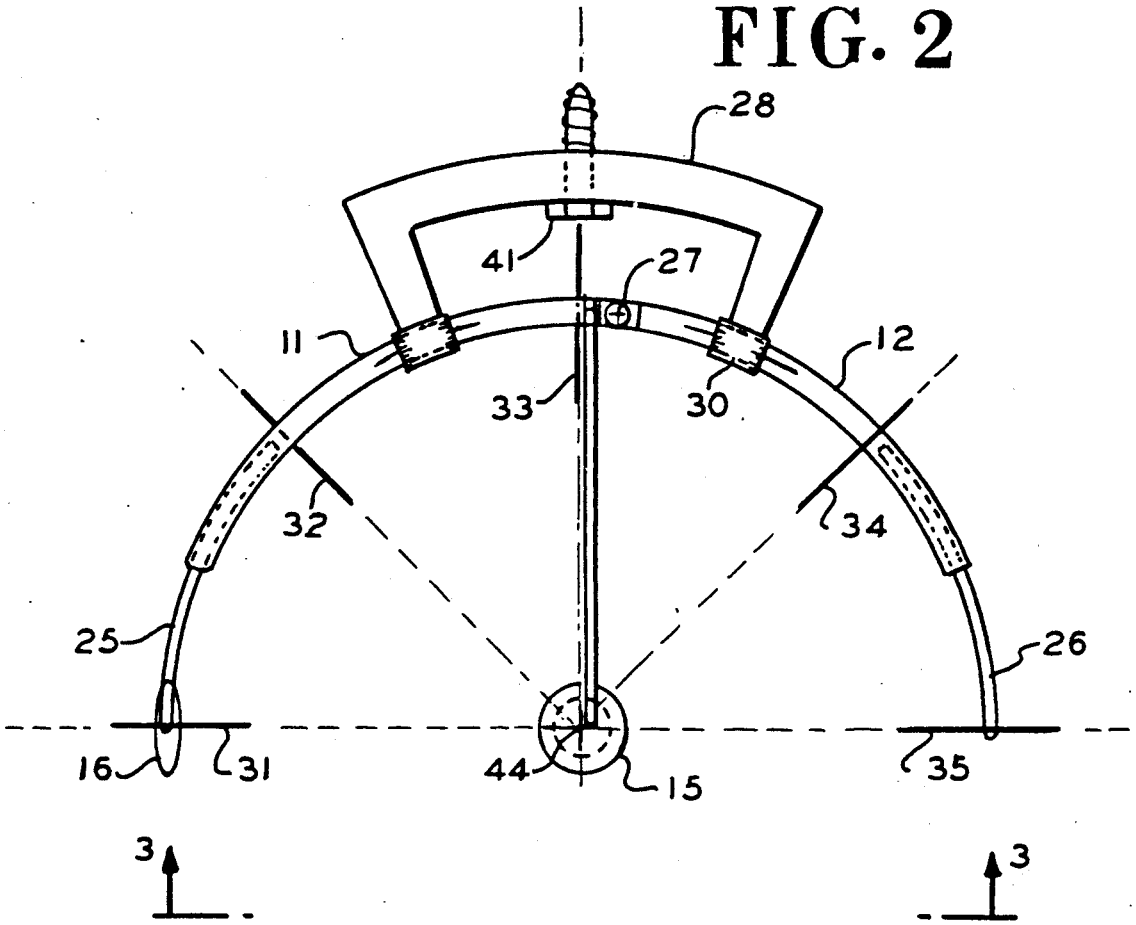
FIG. 2 is a section view as taken along the line 2—2 of FIG. 1.
Figure 3:
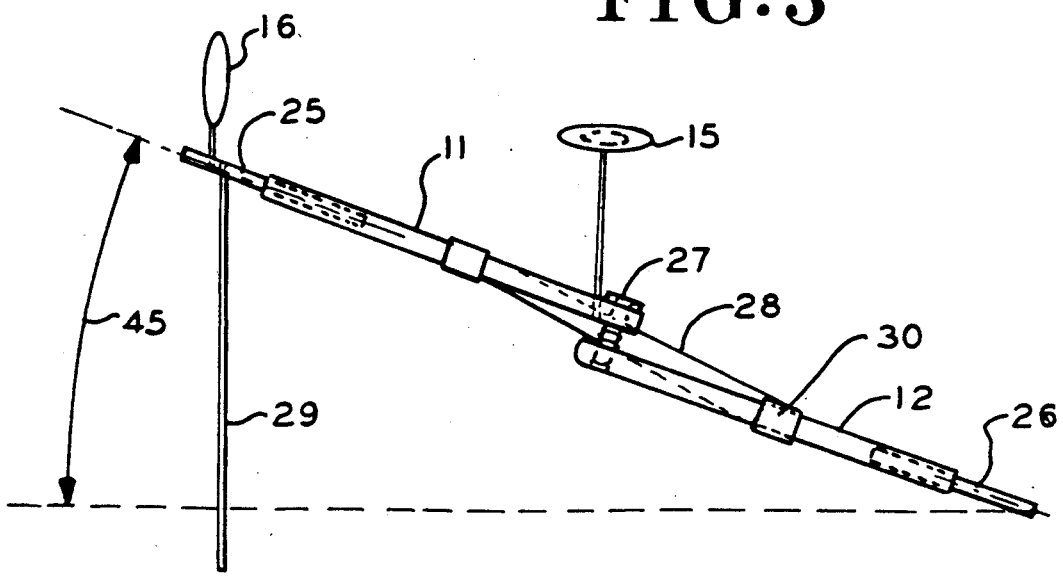
FIG. 3 is a section view as taken along the line 3—3 of FIG. 2.

As shown in FIGS. 1, 2 and 3, a golfer training apparatus or golf training apparatus 70 is provided. Apparatus 70 includes guide assembly 71, support assembly 72, positioning assembly 73, and timer assembly 74 for self-training and self-practice by a golfer 75.

Guide assembly 71 includes a shoulder guide unit 10, which has a left shoulder guide tube 11 and a right shoulder guide tube, 12. Support assembly 72 has a two-piece, self-supporting telescoping main pole 13 and height adjuster 20, which supports guide assembly 71. Guide assembly 71 has a guide arm 14, which is pivotally connected to height adjuster 20 by a connector, such as a bolt and nut.

Positioning assembly 73 includes a head-touching positioning plate 15, and a side-viewing positioning plate or mirror 16. Positioning plate 15 is bracket mounted on guide assembly 71. A golf ball 18 is suspended from a bracket 17, which is mounted on main pole 13. A meter or sensor 19, which is disposed next to golf ball 18, is mounted on main pole 13. Main pole 13 has an adjustable extension member 20, which has a scale for recording the position thereof, and which is adjustable to suit the height and body stance of golfer 75. Member 20 and pole 13 are locked together by a set screw 59. Guide arm 14 has an adjustable extension member 21, which has a scale for recording the position thereof, which is adjustable to suit the arm length, length of golf club and body stance of golfer 75.

Golfer 75, in practice, stands at a selective distance 22 from golf ball 18. Distance 22 varies according to the type of golf club 23 and according to the arm length and body stance of golfer 75. Golf club 23 has a club head 24, which is aligned behind golf ball 18, during the initial positioning of golfer 75, as explained hereafter.

As shown in FIGS. 1, 2 and 3, guide assembly 71 has a left guide extension bar 25, which connects to left shoulder guide tube 11. Guide assembly 71 also has a right guide extension bar 26, which connects to right shoulder guide tube 12. Tubes 11 and 12 are connected by an adjustable pivot screw 27, which adjust the distance between the left sholder guide 11 and the right shoulder guide 12. Tubes 11 and 12 are supported by a cross bar 28, which is supported by adjustable extension member 21. Left guide extension bar 25 has an elongate thin bar 29 which extends normal thereto in a downward direction. Bar 29 is at an angle to the vertical which is parallel to the body of the golfer 75. Golfer 75 can line up his body with the bar 29 when the apparatus 70 has been adjusted and set. The bar 29 can be removed after adjusting and marking for the club selected.

As shown in FIGS. 2 and 4, cross bar 28 has a left cylinder, which supports tube 11, and a right cylinder 30 which supports tube 12. Right cylinder 30, which is identical to the left cylinder, has a scale which corresponds to the angle of the body of golfer 75, and an arrow on its tube 12, so that the parts 12 and 30 can be adjustably fixed to suit the golfer 75. Cylinder 30 has a label 40, which is marked for the setting for each club used.

Guide 71 has a plurality of shoulder toucher or flat sticks or elongate strips 31, 32, 33, 34, 35 for guiding golfer during rotation or swinging of his body. Strip 31, which is identical to strips 32, 33, 34, 35 is rounded at one end for lightly touching golfer 75, and has a scale for recording its position when fitted to golfer 75. Strip 31 is adjustably connected to bar 25 by a standard connector. Strips 32, 33, 34, 35 are adjustably connected to respective members 11, 11, 12, 26. Each said strip has a standard connector, such as a U-bolt with a bar and two nuts or insert.

Timer assembly 74 includes a pendulum weight 6, a pendulum string or wire or chain 37, and an end tie loop 38. Adjustable extension member 20 has a bracket 39 for supporting pendulum string 37 and weight 36. Weight 36 has a time cycle or tempo, which depends on the length of string 37 between bracket 39 and weight 6. The tempo of weight 36 corresponds to the string length, which corresponds to the location of tie loop 38. Tie loop 38 is hooked over one of a plurality of nails or hooks or pins 51, 52, 53, 54, 55, 56, 57, 58, which have respective tempo values of 2.0, 1.9, 1.8, 1.7, 1.6, 1.5, 1.4 and 1.3 seconds, for setting the tempo of pendulum weight 36.

As shown in FIG. 6, member 21 has a lock bolt 41, which threads into a hole in member 21, and has a plate 42 which has an angle scale and which is fixed to member 21. Cross bar 28 has a slotted hole 43, through which bolt 41 extends. Upon setting the cross bar 28 to suit the shoulder angle 45 of the golfer 75, the scale value is recorded and the bolt 41 is tightened. The scale value is read through slotted hole 43.

Golfer 75, who is a specific golfer, has a specific body swing axis 44, which is about the axis of symmetry of the body of golfer 75. Golfer 75 also has a specific shoulder angle, which corresponds to angle 45 in FIG. 3. Golfer 75 has a body tilt angle or body angle 46. Golfer 75 also has a specific height, which partly corresponds to angle 47.

In FIG. 6, member 21 is provided with a label 50 which records the settings for each type of club 23 after apparatus 70 is set and fitted to golfer 75. The settings run in series from D or driver club then, 3 W or #3 wood club, then 5W or 5 wood, then #2 iron or 2I, then 3I, 4I, 5I, 6I, 7I, 8I, and 9I.

For adjusting apparatus 10 to golfer 75, member 20 is set relative to member 13 and a height adjusting screw 59 is tightened. Then, angle 47 of member 14 is set relative to member 20, and a height adjusting angle screw or bolt 60 is tightened. A scale 61, which is added to member 20, shows height of golfer 75. In FIG. 6, adjusting screw 41 is tightened after angle 45, corresponding to the shoulder angle of golfer 75, is set. In FIG. 4, adjusting screw 62 is tightened after tube 12 is set to suit the body tilt angle 46 of golfer 75. In FIG. 6, adjusting screw 63 is tightened after member 21 is set relative to guide arm 14 to suit the arm length of golfer 75.

In FIG. 4, label 40, which shows the type of club for the body angle 46 of golfer 75, is placed on cylinder 30. In FIG. 5, the settings of each of the touching strips 31, 32, 33, 34, 35 is recorded for future use. In FIG. 1, the setting of loop 38 for this golfer 75 is recorded for future use.

In this way, the apparatus 70 is adjusted and set for a specific golfer 75. If the settings are moved, golfer 75 can reset adjusting screws 41, 59, 60, 62, and 63 to suit his specific height, body angle, shoulder angle, and body stance. When changing the club only screw 62 and 63 are adjusted.

In operation and use, golfer 75 follows the actions as indicated in the following Table 1.

Figure 7:
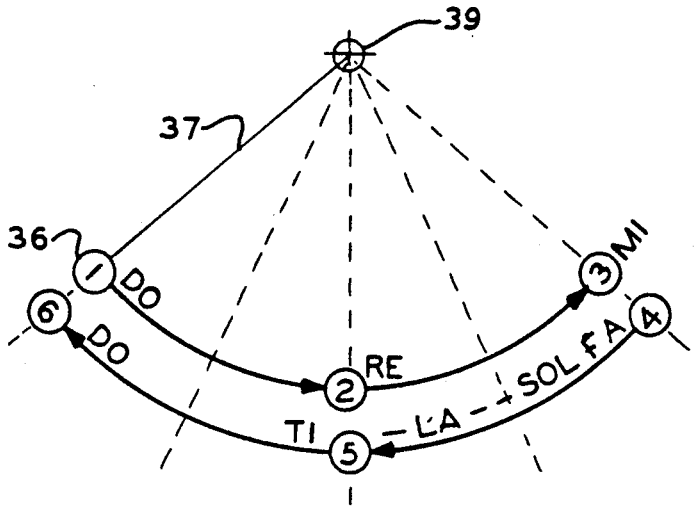
FIG. 7 is a section view as taken along the line 7—7 of FIG. 1.
Figure 8:
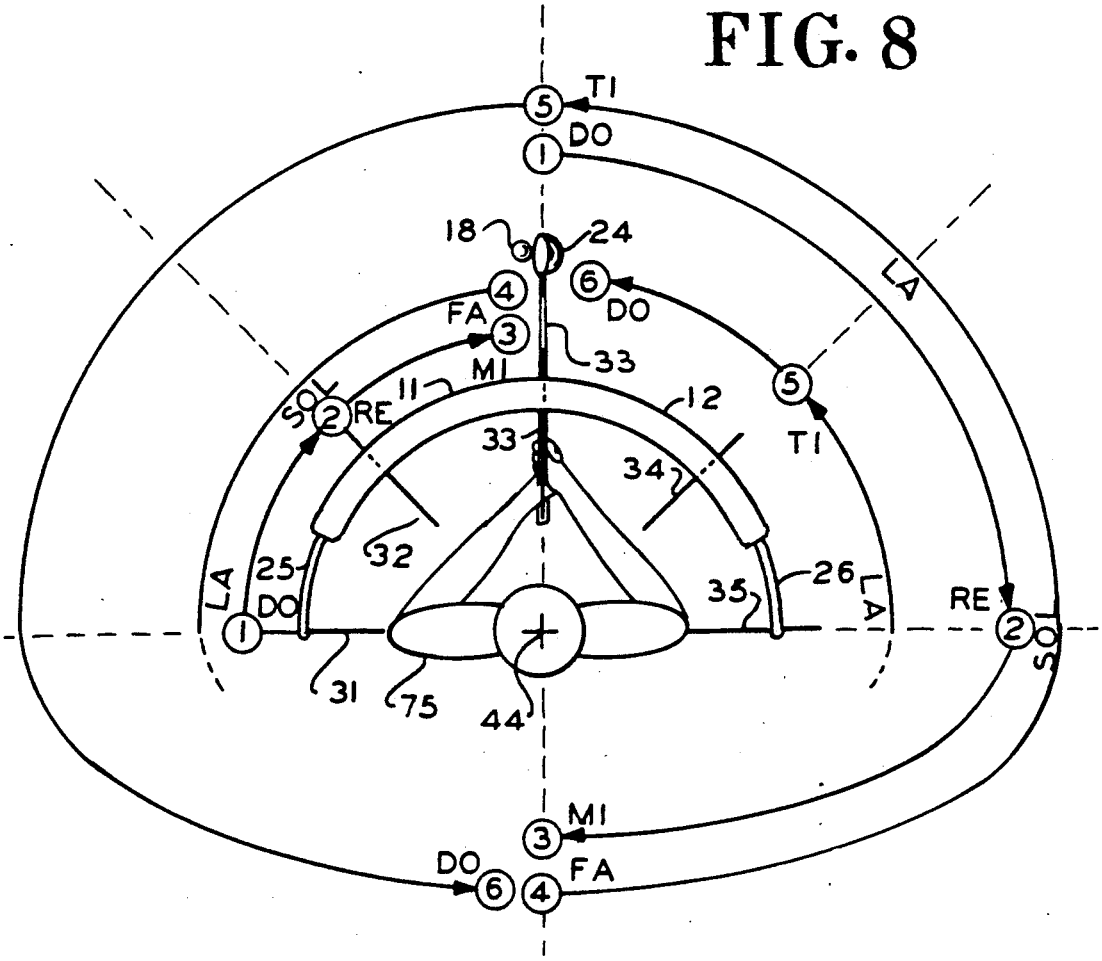
FIG. 8 is a section view as taken along the line 8—8 of FIG. 1.
Figure 9:
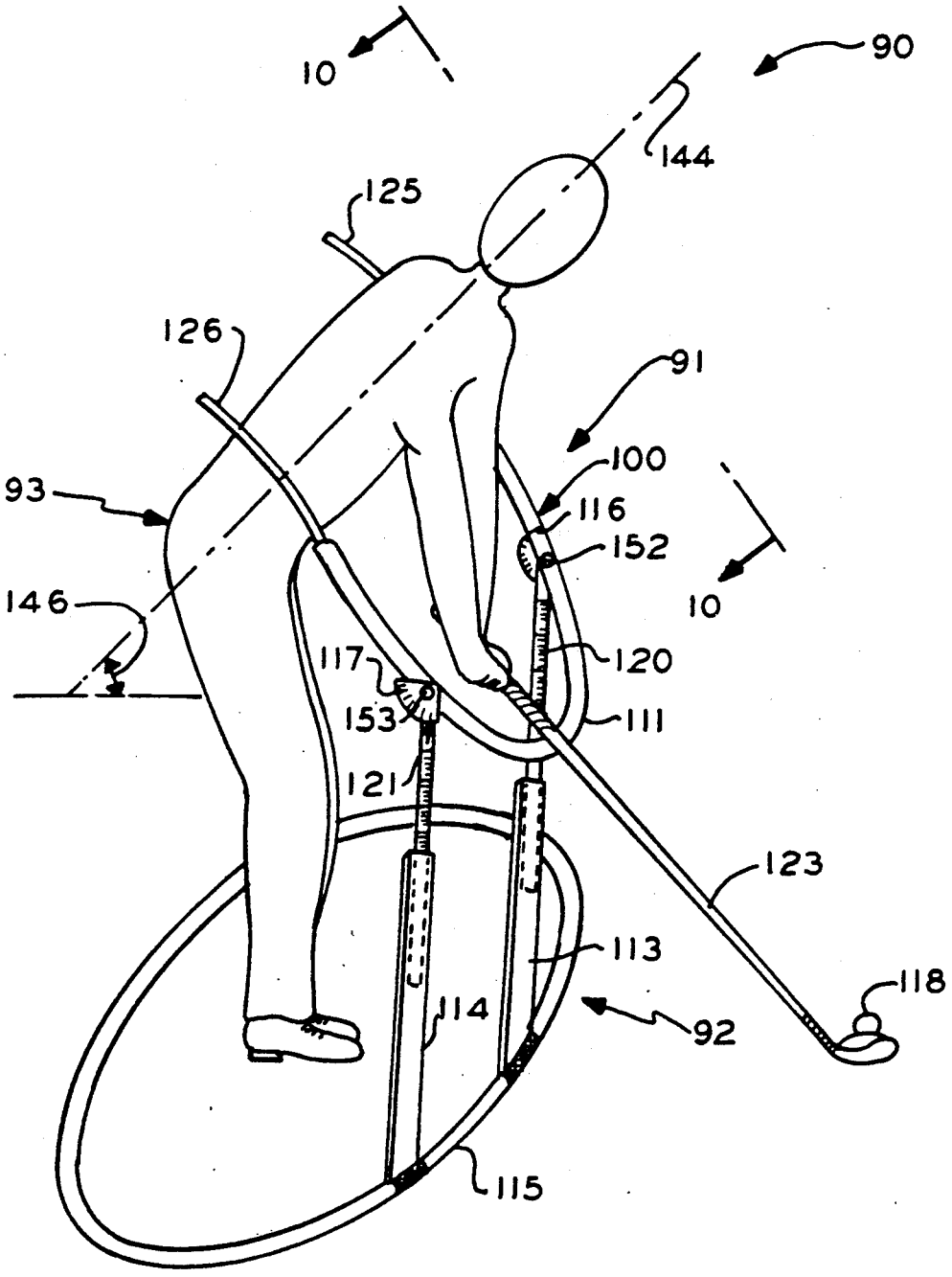
FIG. 9 is a perspective view of a second embodiment of a golfer training apparatus according to the invention.

In operation, as shown in FIG. 7, golfer 75 watches pendulum weight 36 and assigns notes of a conventional musical scale to the positions of weight 36. As shown in FIG. 8, golfer 75 rotates his shoulders about axis 44, while assigning the notes of the conventional musical scale DO, RE, MI, FA, SOL, LA, TI, DO, to specific angular positions of his shoulders. At the same time, golfer 75 holds the club in the conventional manner. Each of the shoulder strips or touches 31, 32, 33, 34, 35 also has a musical note assigned thereto in sequence. The correlation of the timing of pendulum weight 36, and the touching by a shoulder to toucher strips 31, 32, 33, 34, 35, and the foot action, and club swing of golfer 75 is shown in Table 1.

In FIG. 8, the locations of the club head 24 are different from the locations of the rotating shoulder. The musical notes in FIG. 8, located radially inwardly of an arc of club head 24 are the shoulder location notes. The musical notes, in FIG. 8, located radially outwardly of the arc of club head 24 are the club head location notes. For example, where the left shoulder moves through 90 degrees from DO(1) to MI(3), the club head 24 moves through 180 degrees from DO(1) to MI(3).

As shown in FIGS. 9 through 12, a second embodiment or golfer training apparatus 90 is provided. Apparatus 90 includes a guide assembly 91 and a support assembly 92 for a golfer 93. Guide assembly 91 includes a hand guide unit 100, which has a tube 111. Support assembly 92 has a higher left pipe 113 and a lower right pipe 114, both of which are supported by a support stand 115. Pipes 113, 114, each is fixedly connected at its bottom end to stand 115. Left pipe 113 has a left bar 113 which is pivotally connected to a left plate 116, which is fixedly connected to tube 111. A right bar 121 is similarly connected to a right plate 117, which is fixedly connected to tube 111. Left plate 116 has an angle scale for measuring the angle 147 of tube 111 relative to a horizontal line which corresponds to the swing path angle. Left rod 120 is a height adjusting telescoping type of rod. Also, right rod 121 is a similar height-adjusting telescoping type of rod. Rod 120 has an etched arrow, which co-acts with the scale on plate 116 to give the angle of tube 111 relative to the horizontal.

Golfer 93 holds a golf club 123 for hitting a golf ball 118. Tube 111 has a left extension rod 125 for guiding the club path of the follow through and has a right extension rod 126 for guiding the club path of the back swing. Golfer 93 has an axis of symmetry or swing axis 144, Golfer 93 also has a body tilt angle 146. Angle 145, in FIG. 12, which is the angle of a line through the top edges of pipes 113, 114, corresponds to a shoulder angle of golfer 93.

Figure 10:
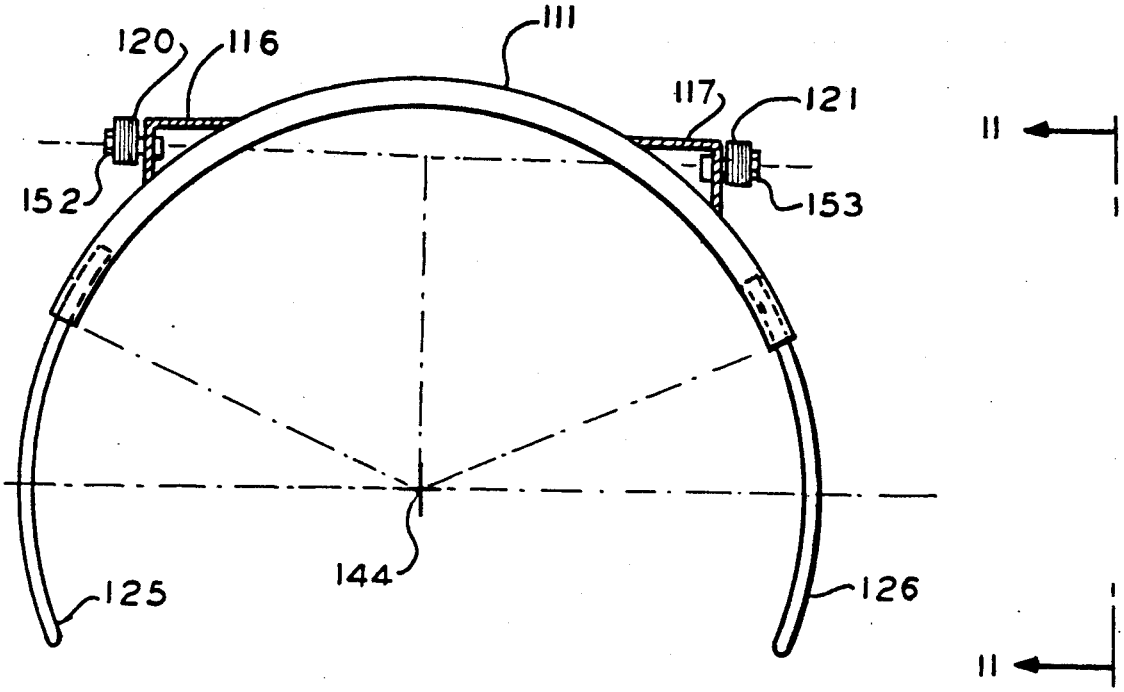
FIG. 10 is a section view as taken along the line 10—10 of FIG. 9.
Figure 11:
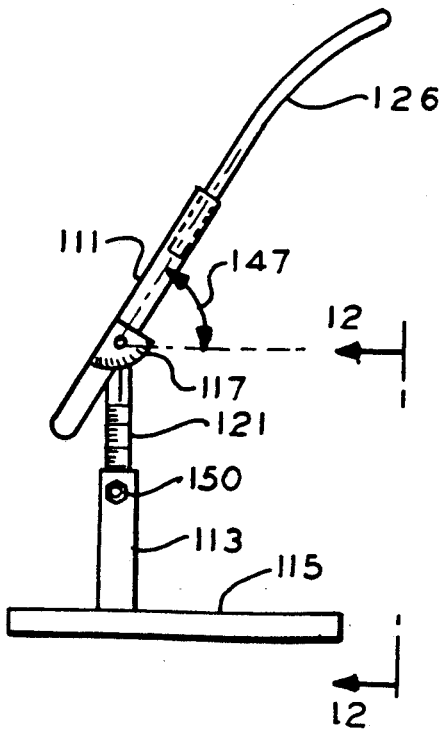
FIG. 11 is a section view as taken along the line 11—11 of FIG. 10.
Figure 12:
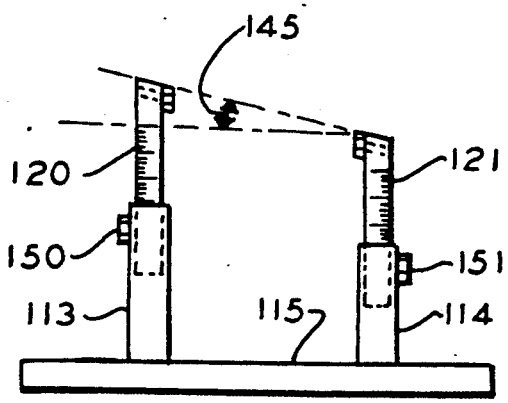
FIG. 12 is a section view as taken along the line 13—13 of FIG. 12.

For adjusting apparatus 90 to suit the height, arm length, body tilt angle 146 and stance of golfer 93, adjusting screws 150, 151 in respective pipes 113, 114 are provided, as shown in FIG. 12. Also, adjusting bolts 152, 153 in respective plates 120, 121 are provided, as shown in FIG. 10. Further, rods 125, 126, as shown in FIG. 1, are adjustable relative to tube 111, by pushing in or pulling out a rod 125 or 126 relative to tube 111.

The advantages of apparatus 70 and 90 are indicated hereafter.

A) Apparatus 70 and 90 can be fitted respectively to the height and arm length and shoulder angle 45, 145 body tilt angle 46, 146 of golfer 75, 93.

B) Head touching plate 15 helps to keep golfer 75 in the same position so that swing axis 44 is not changed in position. Plate 15 is located once for succeeding uses.

C) Shoulder guides 11, 12 and 125, 126 of respective apparatus 70 and 90 maintain the respective swing axes 44 and 144 without relocation, thereby maintaining an improved swing.

D) Shoulder touching strips 31, 32, 33, 34, 35 helps the golfer 75 to rotate about axis 44, and to remember the shoulder location and related club head location for the swing of each type of golf club 23.

E) Timer assembly 74 provides a visual display of a timing cycle for each swing of club 23 by golfer 75. Such timing cycle can be set to suit a most suitable timing cycle for golfer 75 by adjusting loop 38 and the length of pendulum string 37 to a desired pin 52 through 58.

F) Seeing the timing display of timer 74 and feeling the shoulder touching strips 31, 32, 33, 34, 35 and thinking the notes of a musical scale, at the same time, during a swing, helps golfer 75 to memorize the best swing for each type of club.

G) Adjusting guide 111 and setting angle plate 116 helps a golfer 93 using apparatus 90 to fit the apparatus to his height and arm length and body angle thereby improving his hand and club coordination.

H) Cost of manufacture of apparatus 90 in minimized.

While the invention has been described in its preferred embodiment, it is to be understood that the words which have been used are words of description rather than limitation and that changes may be made within the purview of the appended claims without departing from the true scope and spirit of the invention in its broader aspects.

TABLE 1

| | | | | | | | | | |
|---|---|---|---|---|---|---|---|---|---|
| MOVING PENDULUM | | 1 | 2 | 3 | 4 | | 5 | | 6 |
| TOUCHOR NO. | LEFT | 31 | 32 | 33 | 33 | | 32 & 31 | | |
| TOUCHING BY SHOULDER | RIGHT | | | | | | 35 & 34 | | 33 |
| LEADING SHOULDER SWING RHYTHYM | | LEFT | LEFT | LEFT | LEFT | | LEFT & RIGHT | | RIGHT |
| SWING SOUND | | DO | RE | MI | FA | SOL | LA | TI | DO |
| FOOT ACTION | | | | LEFT UP | LEFT DOWN | | RIGHT UP | | |
| CLUB SWING | | BACK SWING | | | DOWN SWING | | | IMPACT | FOLLOW THROUGH |

What is claimed is:

1. A golf training apparatus comprising: guide means; shoulder support means and hand guide means; adjusting means for adjusting the shoulder and hand guide means to suit the height and arm length and body tilt angle and shoulder angle of a golfer for each club, and timer means having a pendulum weight and suspension member for setting the time cycle of a swing over a desired time interval.

2. The apparatus of claim 1, wherein the shoulder and hand guide means includes positioning means for ease of adjusting the shoulder and hand guide means; said positioning means having a head plate for setting a body swing axis of symmetry of the golfer at a preselected body tilt angle.

3. The apparatus of claim 1, wherein the shoulder and hand guide means includes a guide unit of semi-circular shape; said guide unit having a center position with a left shoulder extension and a right shoulder extension connected to respective ends thereof.

4. The apparatus of claim 3, wherein the adjusting means includes a first adjustable left shoulder center portion extension; a second adjustable right shoulder center portion extension; a third adjustable pivot means connected to the center portion; a fourth elongate adjustable length member having one end connected to the third adjustable first means and having an opposite end; a fifth adjustable pivot means mounted on the opposite end of fourth member; and a sixth adjustable support member connected to the fifth adjustable means having an adjustable two-piece telescoping elongate member for adjusting the center portion to the height and arm length of the golfer.

5. The apparatus of claim 4, wherein the third adjustable pivot means connected to the center portion is also connected to a cross bar; seventh adjusting means connected to the cross bar for setting the angle of the cross bar to conform to a shoulder angle of the golfer.

6. The apparatus of claim 3, wherein the guide unit has five shoulder touching strips spaced apart at 45 degrees.

7. The apparatus of claim 1, wherein the timer means has adjusting means for setting the time interval on one of a series of values of time.

8. The apparatus of claim 1, wherein the adjusting means includes: a hand guide unit having a center portion; said center portion having adjustable extensions at opposite ends thereof; a pair of adjustable hinges for setting an angle of the center portion to be suited to the height and arm length of the golfer; a pair of adjustable elongate support members connected respectively to the pair of hinges; each said support member having adjusting means for setting the height of the pair of hinges to suit the height of the golfer.

* * * * *